US006863565B1

(12) United States Patent
Kogan et al.

(10) Patent No.: US 6,863,565 B1
(45) Date of Patent: Mar. 8, 2005

(54) CONSTANT IMPEDANCE BULLET CONNECTOR FOR A SEMI-RIGID COAXIAL CABLE

(75) Inventors: Eduard Kogan, Cheshire, CT (US); Donald V. Lemke, Naperville, IL (US); Harold D. Niver, Waterbury, CT (US)

(73) Assignee: Palco Connector Incorporated, Naugatuck, CT (US)

( * ) Notice: Subject to any disclaimer, the term of this patent is extended or adjusted under 35 U.S.C. 154(b) by 0 days.

(21) Appl. No.: 10/890,488

(22) Filed: Jul. 13, 2004

(51) Int. Cl.[7] ..... H01R 9/05
(52) U.S. Cl. ..... 439/580
(58) Field of Search ..... 439/578, 579, 439/580

(56) References Cited

U.S. PATENT DOCUMENTS

| | | | | |
|---|---|---|---|---|
| 4,444,453 | A | | 4/1984 | Kirby et al. |
| 4,917,630 | A | | 4/1990 | Hubbard |
| 4,966,560 | A | | 10/1990 | Marzouk |
| 5,516,303 | A | | 5/1996 | Yohn et al. |
| 5,676,565 | A | | 10/1997 | Vagnoni |
| 5,785,554 | A | | 7/1998 | Ohshiro |
| 5,882,233 | A | | 3/1999 | Idehara |
| 5,967,852 | A | | 10/1999 | Follingstad et al. |
| 6,769,933 | B2 | * | 8/2004 | Bence et al. ..... 439/578 |
| 6,773,303 | B1 | * | 8/2004 | Lin ..... 439/578 |
| 6,805,583 | B2 | * | 10/2004 | Holliday et al. ..... 439/578 |
| 2002/0090860 | A1 | | 7/2002 | Bohmer et al. |

FOREIGN PATENT DOCUMENTS

| | | |
|---|---|---|
| GB | 2057781 A | 1/1981 |
| WO | WO89/03600 | 4/1989 |

* cited by examiner

*Primary Examiner*—Thanh-Tam Le
(74) *Attorney, Agent, or Firm*—DeLio & Peterson, LLC; Robert Curcio

(57) ABSTRACT

A connector or first plug is provided for receiving a mating plug or second plug, forming a constant impedance connection. The center conductor of the first plug is supported for enhanced structural integrity with a cap attached over a portion of the center conductor that extends beyond the outer conductor portion of the same plug. The constant impedance connection consists of the two plugs partially or fully engaged. The mating plug has an outer conductor that projects beyond the inner conductor, and is made to receive the connector or first plug portions. Once engaged, the connector and mating plug have mating dimensions that satisfy an impedance equality expression for a relationship between the inner conductor cap's outer diameter, the outer conductor's inner diameter, and the dielectric constant.

15 Claims, 2 Drawing Sheets

CONSTANT IMPEDANCE BULLET CONNECTOR FOR A SEMI-RIGID COAXIAL CABLE

BACKGROUND OF THE INVENTION

1. Field of the Invention

This invention relates to transmission line connectors, specifically connectors for semi-rigid coaxial cables, and more particularly to connectors having an inner conductor support and are capable of providing a constant impedance connection for the signal path, including when the connectors are only partially engaged.

2. Description of Related Art

Connectors link the various conductors of transmission lines to equipment or other cables. A coaxial cable connector provides an electrical conductive contact between conductors of electricity in a coaxial cable; wherein the joint is of a type that may be readily made and broken, repeatedly by attachment and detachment of contact supporting structure on each conductor.

The connectors usually include a small projecting male center conductor and a corresponding female center conductor made to mechanically and electrically receive the male portion.

The center conductor portion of the connector is quite fragile and prone to damage. The center conductor portion can become damaged when, for example, the connector is misaligned during a connection. This is likely to happen during "blind-mate" connections, remotely located connections, and quick connect/disconnect applications. Generally, the center conductor is made of a bendable copper wire of finite diameter, having little or no mechanical support to resist bending or other forces. In typical coaxial connectors, the male portion of the center conductor projects and extends out beyond the outer conductor for insertion into the female portion. Thus, the center conductor tip of a coaxial cable connector is exposed and vulnerable to handling and deforming during insertion.

A coaxial cable or connector as identified above, has a characteristic impedance determined by the geometry of the cable or connector structure and the corresponding dielectric material between the conductors. The characteristic impedance may be represented by the formula:

$$Z=138\ (\epsilon)^{-1/2}\ \log(D/d),$$

where,

Z is the impedance of the line;

D is the inner diameter of the outer conductor;

d is the outer diameter of the inner conductor; and $\epsilon$ is the relative dielectric constant.

Importantly, the connector must also exhibit this same impedance. Otherwise, signal disruption and reflections will degrade the signal quality due to the impedance mismatch. This is especially true in the higher frequency regimes, in applications where the signal frequency is on the order of 1 gigaHertz and higher.

Although the prior art has attempted in numerous ways to minimize the impedance mismatches that normally occur in connectors, there is no teaching or suggestion to strengthen the bendable center conductor or provide any form of structural support to the center conductor while keeping the impedance constant throughout the connector engagement.

Bearing in mind the problems and deficiencies of the prior art, it is therefore an object of the present invention to provide a constant impedance connector that can maintain the constant impedance when the connector is partially or fully engaged while employing a support structure on the center conductor.

It is another object of the present invention to provide a coaxial connector center conductor that will not easily bend or deform during alignment or blind connection, and maintains constant impedance when mated with a corresponding female connector.

Still other objects and advantages of the invention will in part be obvious and will in part be apparent from the specification.

SUMMARY OF THE INVENTION

The above and other objects, which will be apparent to those skilled in art, are achieved in the present invention, which is directed to an electrical connector jack having a free end and a fixed end comprising: an inner conductor of a coaxial cable having an outer diameter and a free end, an outer conductor of the coaxial cable having an inner diameter and a free end, the inner conductor coaxial with the outer conductor, the inner and outer conductor free ends coincident with the connector jack free end, the inner conductor free end projecting beyond the outer conductor free end; the fixed end attachable to the coaxial cable having a dielectric spacer between the inner and outer conductors, and extending up to the outer conductor free end; an electrically conductive cap substantially covering the inner conductor free end projected beyond the outer conductor free end, the cap coaxial with the inner conductor, substantially cylindrical, and having an inner diameter substantially equal to the inner conductor outer diameter, and having an outer diameter slightly larger than the inner conductor outer diameter; the connector jack engaging and electrically connected with a coaxial mating plug having corresponding inner and outer conductors and at least dielectric spacer therebetween; and wherein the inner and outer conductors of the connector jack and the mating plug are shaped, and material for the dielectric spacers is chosen, such that when the connector jack is engaged with the mating plug, along the central axis of the engaged connection the effective outer diameter of the inner conductor referenced by "d", the effective inner diameter of the outer conductor referenced by "D", and a relative dielectric constant of the medium therebetween referenced by $\epsilon$, satisfy the equation: $Z=138\ (\epsilon)^{-1/2}\ \log\ (D/d)$, where "Z" is the impedance, and the impedance is substantially constant throughout the central axis of the engaged connection.

In a second aspect, the present invention is directed to a coaxial electrical connector comprising: a first plug including: a first plug free end, a first plug fixed end, a first plug inner conductor of a first coaxial cable having an outer diameter and a free end, and a first plug outer conductor of the first coaxial cable having an inner diameter and a free end, the first plug inner conductor coaxial with the first plug outer conductor, the first plug inner conductor free end coincident with the first plug free end, the first plug inner conductor free end projecting beyond the first plug outer conductor free end; a second plug including: a second plug free end, a second plug fixed end, a second plug inner conductor of a second coaxial cable having an outer diameter and a free end, and a second plug outer conductor of the second coaxial cable having an inner diameter and a free end, the second plug inner conductor coaxial with the second plug outer conductor, the second plug outer conductor free end coincident with the second plug free end, the second plug outer conductor free end projecting beyond the second plug inner conductor free end; a bullet shaped cover comprising: a conductive cover substantially covering the first plug inner conductor free end projected beyond the outer conductor free end, the cover coaxial with the first plug inner conductor, substantially cylindrical, and having an inner diameter substantially equal to the first plug inner conductor outer diameter, and having an outer diameter slightly larger than the first plug inner conductor outer diameter; and wherein the fixed ends each adapted to attach to the coaxial cables having a dielectric between the inner and outer conductors; wherein the first plug inner conductor free end projecting beyond the first plug outer conductor free end connects with the second plug inner conductor free end, and the second plug outer conductor free end projecting beyond the second plug inner conductor free end connects with the first plug outer conductor free end, such that the connector forms an overlap region when the plugs are electrically connected and at least partially engaged; and wherein the first plug engages and connects with the second plug to form a continuous signal pathway through the plugs and the overlap region, whereby signal impedance "Z" remains substantially constant throughout the connector including within the overlap region, having the overlap region form part of the signal pathway.

In a third aspect, the present invention is directed to an electrical connector plug forming a signal path, the connector plug having a free end and a fixed end, comprising: an inner conductor having an outer diameter and a free end, an outer conductor having an inner diameter and a free end, the inner conductor coaxial with the outer conductor, the inner conductor free end coincident with the connector plug free end, the inner conductor free end projecting beyond the outer conductor free end; a dielectric spacer between the inner and outer conductors having a dielectric constant; the fixed end attachable to a coaxial cable; an electrically conductive cap substantially covering the inner conductor free end projecting beyond the outer conductor free end, the cap coaxial with the inner conductor, substantially cylindrical, and having an inner diameter substantially equal to the inner conductor outer diameter, and having an outer diameter larger than the inner conductor outer diameter; the connector plug adapted to engage and electrically connect with a coaxial mating plug having corresponding inner and outer conductors and a dielectric spacer therebetween having the dielectric constant; wherein the free end of the projecting conductor of the connector plug and the cap are adapted to overlap with the free end of the projecting conductor of the mating plug, forming an overlap region when the plugs are electrically connected and at least partially engaged; and wherein all along the signal path, the ratio of the inner diameter of the outer conductor to the outer diameter of the inner conductor along with the dielectric constant being such that the impedance is substantially constant throughout the central axis of the connector plug.

In a fourth aspect, the present invention is directed to a coaxial electrical connector plug having a free end and a fixed end, comprising: an outer conductor having an inner diameter $D_1$; an inner conductor having an outer diameter $d_1$; a portion of the inner conductor extending beyond the outer conductor at the connector plug's free end; a conductive cap over the inner conductor portion extending beyond the outer conductor, the cap having an outer diameter $d_3$; wherein the connector plug is adapted to connect with a mating plug having an inner conductor with an outer diameter $d_2$, an outer conductor with an inner diameter $D_2$, and a portion of the outer conductor extending beyond the inner conductor, the portion outer conductor having an inner diameter $D_3$; such that when the connector plug is at least partially engaged with the mating plug, the ratios of the diameters: $D_1/d_1$, $D_2/d_2$, and $D_3/d_3$ are substantially equal.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
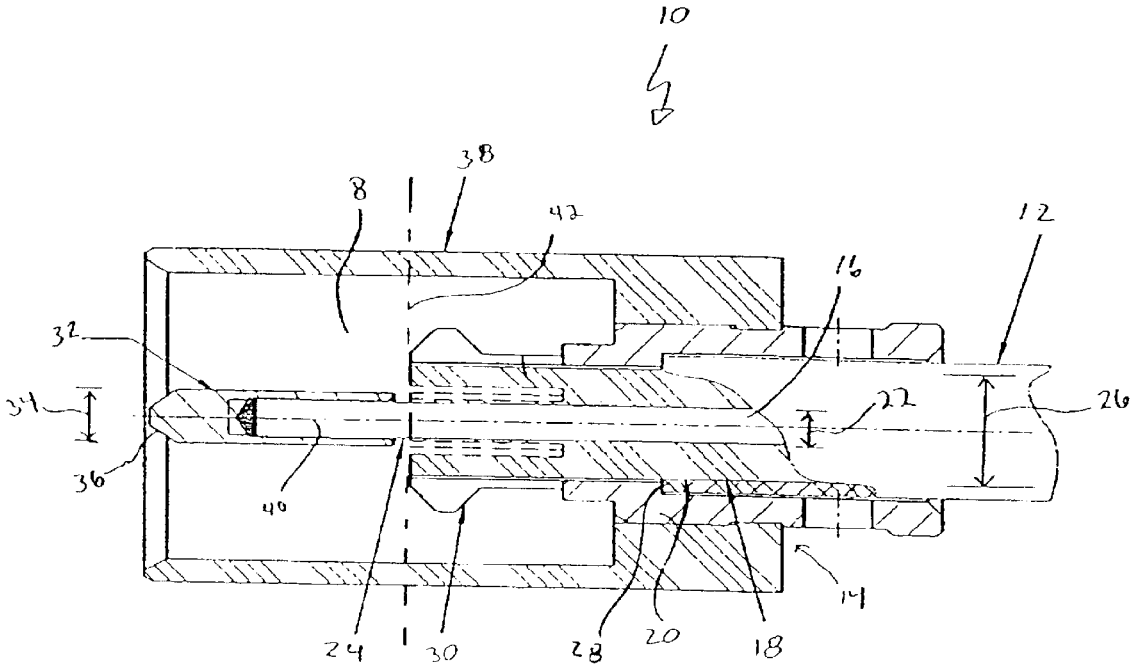
FIG. 1 depicts a cross-sectional view of the male connector plug of the present invention.

In describing the preferred embodiment of the present invention, reference will be made herein to FIGS. 1–3 of the drawings in which like numerals refer to like features of the invention.

In accordance with the present invention, a plug is provided for a constant impedance connector, and for mating to a second plug. Importantly, the center conductor of the plug is supported for enhanced structural integrity. The constant impedance connector consists of the two mating plugs. The first plug, commonly referred to as a male plug, has an inner conductor that projects beyond the outer conductor. The second plug, commonly referred to as a female plug, has an outer conductor that projects beyond the inner conductor, and is made to receive the male plug portions.

Each plug is provided with an inner conductor, an outer conductor, and a dielectric spacer therebetween. FIG. 1 depicts a cross-sectional view of the male connector plug 10 of the present invention. A semi-rigid coaxial cable 12 is joined at the male connector plug's fixed end 14. The coaxial cable 12 includes an inner or center conductor 16, a dielectric spacer 18, and outer conductor 20. The inner conductor 16 has an outer diameter 22 and a free end 24. The free end 24 extends beyond the outer conductor 20. The outer conductor 20 has an inner diameter 26, and a free end 28. The inner conductor is coaxial with the outer conductor. The inner conductor free end 24 is shown projecting beyond the outer conductor free end 28. The end may then be slightly compressed to make electrical contact with the free end of a mating outer conductor. The outer conductor 20 physically and electrically connects to conductive spring fingers 30. The spring fingers are made to form electrical contact with the outer conductor of a female mating plug that would slip over and make electrical contact with the male plug's outer conductor. In at least one embodiment, the cable's dielectric insulation extends to the plane 42 at the tip of the spring fingers. The insulation may not extend as far in other embodiments. An electrically conductive cap or bullet 32 substantially covers the inner conductor free end 24 projected beyond the outer conductor free end, on the opposite side of the plane 42 from the spring fingers 30. The cap is coaxial with the inner conductor, substantially cylindrical, and has an inner diameter substantially equal to the inner conductor outer diameter 22, and an outer diameter 34 slightly larger than the inner conductor outer diameter. Unlike the prior art, where stepped cylindrical segments are taught, the outer diameter 34 of the cap or bullet 32 is substantially constant throughout the cap's length. A slight curvature is made at the tip 36, but does not contribute in any manner to the connector's impedance since the curved portion is made to be completely encompassed by a female plug's inner conductor. The cap provides structural integrity to the center conductor, and electrical contact to the female plug inner conductor. The cap's constant diameter facilitates constant characteristic impedance for the signal throughout the connector.

Furthermore, since the cable 12 is directly inserted within the plug, and not terminated or separated at the plug's backend or fixed end 14, there is no impedance mismatch for the signal as it traverses through the plug's backend.

The male connector plug 10 is configured to adapt with a female plug connector attachable to a coaxial cable having corresponding inner and outer conductors via a corresponding guide. A circular body 38, which may be, but not necessarily be, made of plastic, is attached at the fixed end of the male connector plug, principally used to guide and secure the male and female connectors together. Upon attachment, the guide also protects the electrical connections from external forces and environmental elements. The guide may be an integral portion of a multi-guide unit. The inner and outer conductors of the male connector plug and the female connector plug are of predetermined shape, and the material for the coaxial cable dielectric is chosen, such that when the male connector plug is engaged with the female connector plug, along the central axis 40 of the engaged connection, the effective outer diameter of the inner conductor referenced by "d", the effective inner diameter of the outer conductor referenced by "D", and the relative dielectric constant of the medium therebetween referenced by $\epsilon$, satisfy the equation:

$$Z=138(\epsilon)^{-1/2}\log(D/d)$$

where "Z" is the impedance. The geometry is determined and the dielectric material selected so that anywhere along the central axis of the connector the impedance is substantially constant.

Importantly, the addition of the cap alters the geometry of the plugs so that constant impedance is ensured throughout the connector. The female plug must have an inner conductor with inner diameter large enough to encompass the male plug's cap 32 outer diameter. The female plug must also have an outer conductor diameter and corresponding dielectric portion that maintains the impedance equality as it engages the bullet cap on the inner conductor of the male plug.

The cap 32 is made of a conductive material that is structurally stronger and more robust to withstand bending and compression forces than the conductive material of the center conductor. Preferably, the cap is made of a structure plated with high conductive non-oxidizing material such as gold. The cap may be attached by solder, compression fit, or other non-destructive means that establishes and maintains the center conductor's conductivity after attachment. The attachment is designed to be a low loss impedance interface. The cap's tip 36 is significantly smaller in length than the length of the cap that extends over and covers the projected portion 24 of the center conductor. The tip is rounded, or bullet-shaped. It is adapted to be easily inserted within a hollow inner conductor cylinder of a mating female plug.

In the present design, the electric signal passes through an overlap region in the connector between the two connector halves defined by the inner conductor bullet cap and an outer conductor on the mating socket of the female plug. To achieve the desired constant impedance and correct operation at high frequency, the diameters of the inner and outer conductors are changed within the overlap region to compensate for the extended diameter created by the bullet cap over the inner conductor. The spring fingers contact the outer conductor of the female plug to form a continuous outer conductor connection. The bullet-cap acts to change the diameter of the inner conductor, which is further compensated by the female plug's dielectric spacer and outer conductor to satisfy the impedance equality expression.

Figure 2:
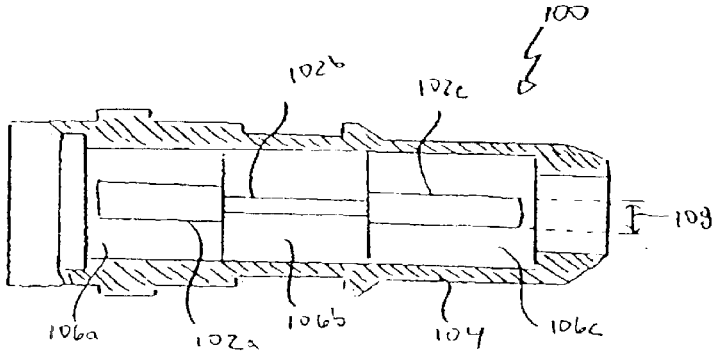
FIG. 2 depicts a cross-sectional view of a female connector plug for mating with male plug of the present invention.
Figure 3:
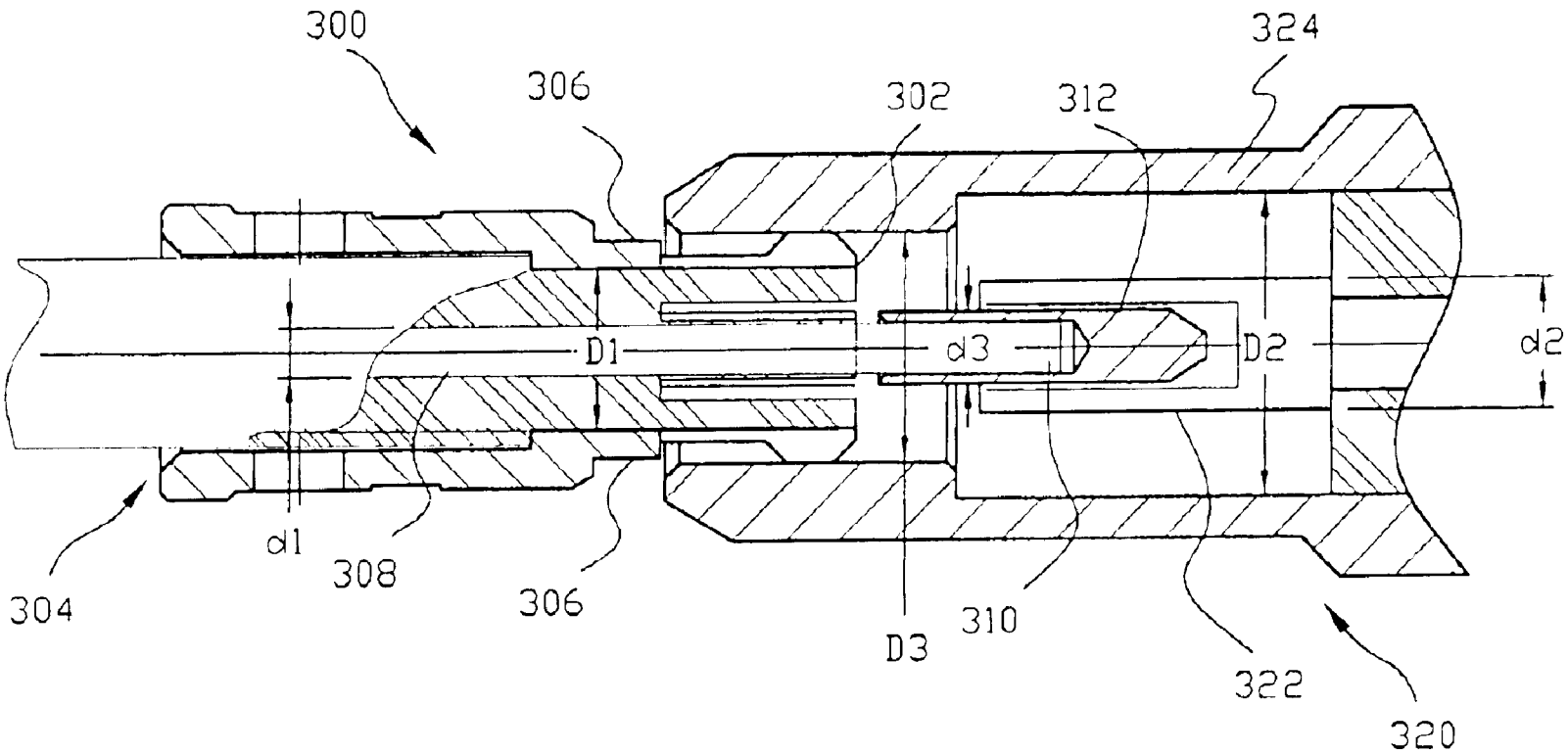
FIG. 3 depicts a cross-sectional view of a partially engaged connector with constant dielectric constants throughout.

FIG. 2 depicts a cross-sectional view of a female connector plug 100 for mating with male plug 10. Just as in the construction of the male plug, the inner and outer conductors of the female plug are of unequal lengths. However, in the female plug, the outer conductor is longer and projects beyond the inner plug. The mating female plug 100 is shown with three inner conductor regions 102*a–c*, each having different outer diameters, an outer conductor 104 having an inner diameter that may remain constant, and at least one dielectric spacer 106 therebetween, preferably in position 106*b*. Inner conductor 102*c* is made to receive the bullet-cap of the male plug. The inner diameter 108 of inner conductor 102*c* is at least as large as the outer diameter 34 of the bullet-cap. Similarly, the inner diameter of the outer conductor 104 is at least as large as the outer diameter of the outer conductor of the male plug. The outer conductor 104 slides over and compresses the spring fingers of the male plug to make a low loss contact. The inner and outer dimensions of the dielectric spacer 106*b* and the associated conductor diameters in each depicted region are adjusted to maintain constant impedance as the signal passes from one region to the next over the length of the connector. For a dielectric material, in order to maintain constant impedance, the ratio of outer diameters to inner diameters for each region must be held constant. For changing dielectric mediums, for example from one dielectric medium to another, the following equality must be maintained:

$$(\epsilon_2)^{-1/2}\log(\text{'}D_2/d_2)=(\epsilon_1)^{-1/2}\log(D_1/d_1)$$

where, $\epsilon_1$ and $\epsilon_2$ are the relative dielectric constants for mediums 1 and 2, respectively.

As a signal passes through each region, as long as the above equality is maintained, the signal will propagate through mediums of constant and equal impedance as it does in the coaxial cable itself.

Importantly, in region 102*c* the inner conductor has an inner diameter that accommodates the outer diameter of the bullet-cap. In this instance, accommodation means that the diameters are adjusted to maintain the impedance equality. During connection, the bullet-cap is inserted within and slideably contacted to inner conductor 102*c*. The inner diameter of the outer conductor is adjusted to satisfy the above-identified expression.

When an electrical connection is formed, an overlap region is created, defined by the enlarged projecting portion of the male plug's inner conductor, which is the bullet-cap region, and the shortened outer conductor, in concert with the elongated, extended outer conductor portion of the female plug connector, and corresponding dielectric spacer. As the connector slides from a partial engagement to a full engagement, the overlap region diminishes in size as the outer conductor of the female mating plug slides over the outer conductor of the male plug.

When the dielectric constants are the same throughout, only the ratios of the diameters are needed to maintain the impedance equality. For example, FIG. 3 depicts a partially engaged connector with constant dielectric constants throughout. A coaxial electrical connector jack 300 is shown with a free end 302 and a fixed end 304. The jack includes an outer conductor 306 having an inner diameter $D_1$, and an inner conductor 308 having an outer diameter $d_1$. A portion 310 of the inner conductor 308 is shown extending beyond the outer conductor 306 at the connector jack's free end 302. A conductive cap 312 over the inner conductor portion 310 extends beyond the outer conductor 306. The cap 312 has an outer diameter $d_3$. The connector jack 300 is adapted to connect with a mating plug 320, which has an inner conductor 322 with an outer diameter $d_2$, an outer conductor 324 with an inner diameter $D_2$, and a portion 326 of the outer conductor 324 that extends beyond the inner conductor 322. The extended portion outer conductor 326 has an inner diameter $D_3$. Importantly, when the connector jack is at least partially engaged with the mating plug, the ratios of the diameters: $D_1/d_1$, $D_2/d_2$, and $D_3/d_3$ are made to satisfy the equality: $D_1/d_1=D_2/d_2=D_3/d_3$. This ensures negligible impedance mismatch at each interface.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An electrical connector jack having a free end and a fixed end comprising:

an inner conductor of a coaxial cable having an outer diameter and a free end, an outer conductor of said coaxial cable having an inner diameter and a free end, said inner conductor coaxial with said outer conductor, said inner and outer conductor free ends coincident with said connector jack free end, said inner conductor free end projecting beyond said outer conductor free end;

said fixed end attachable to said coaxial cable having a dielectric spacer between said inner and outer conductors, and extending up to said outer conductor free end;

an electrically conductive cap substantially covering said inner conductor free end projected beyond said outer conductor free end, said cap coaxial with said inner conductor, substantially cylindrical, and having an inner diameter substantially equal to said inner conductor outer diameter, and having an outer diameter slightly larger than said inner conductor outer diameter;

said connector jack engaging and electrically connected with a coaxial mating plug having corresponding inner and outer conductors and at least dielectric spacer therebetween; and wherein the inner and outer conductors of said connector jack and said mating plug are shaped, and material for the dielectric spacers is chosen, such that when said connector jack is engaged with said mating plug, along the central axis of the engaged connection the effective outer diameter of the inner conductor referenced by "d", the effective inner diameter of the outer conductor referenced by "D", and a relative dielectric constant of the medium therebetween referenced by $\epsilon$, satisfy the equation:

$$Z=138(\epsilon)^{-1/2}\log(D/d)$$

where "Z" is the impedance, and the impedance is substantially constant throughout the central axis of said engaged connection.

2. The connector jack of claim 1 wherein said mating plug includes a free end, said mating plug inner conductor adapted to mate with said connector jack inner conductor with said cap, said mating plug outer conductor adapted to mate with said connector jack outer conductor, and said mating plug outer conductor free end projecting beyond said mating plug inner conductor free end.

3. The connector jack of claim 2 wherein said free end of said projecting conductor of said connector jack with said cap is adapted to overlap with said free end of said projecting conductor of said mating plug, forming an overlap region when said jack and said plug are electrically connected and at least partially engaged.

4. The connector jack of claim 3 wherein said connector jack engages and connects with said mating plug to form a continuous signal pathway through said jack, said plug, and said overlap region, whereby said impedance "Z" remains substantially constant within said overlap region, having said overlap region form part of a signal pathway.

5. The connector jack of claim 4 further comprising having said impedance remain constant throughout said central axis of said engaged connection as said jack and said plug are moved from a first electrically connected, partially engaged position to an electrically connected, fully engaged position.

6. The connector jack of claim 1 wherein said cap is bullet-shaped, having a cylindrical body and a contoured, slightly pointed end, said cylindrical body having a substantially constant outer diameter.

7. The connector jack of claim 6 including having said cylindrical body completely encompass said connector jack inner conductor free end projecting beyond said connector jack outer conductor free end.

8. A coaxial electrical connector comprising:

a first plug including:

a first plug free end, a first plug fixed end, a first plug inner conductor of a first coaxial cable having an outer diameter and a free end, and a first plug outer conductor of said first coaxial cable having an inner diameter and a free end, said first plug inner conductor coaxial with said first plug outer conductor, said first plug inner conductor free end coincident with said first plug free end, said first plug inner conductor free end projecting beyond said first plug outer conductor free end;

a second plug including:

a second plug free end, a second plug fixed end, a second plug inner conductor of a second coaxial cable having an outer diameter and a free end, and a second plug outer conductor of said second coaxial cable having an inner diameter and a free end, said second plug inner conductor coaxial with said second plug outer conductor, said second plug outer conductor free end coincident with said second plug free end, said second plug outer conductor free end projecting beyond said second plug inner conductor free end;

a bullet shaped cover comprising:

a conductive cover substantially covering said first plug inner conductor free end projected beyond said outer conductor free end, said cover coaxial with said first plug inner conductor, substantially cylindrical, and having an inner diameter substantially equal to said first plug inner conductor outer diameter, and having an outer diameter slightly larger than said first plug inner conductor outer diameter; and wherein said fixed ends each adapted to attach to said coaxial cables having a dielectric between said inner and outer conductors;

wherein said first plug inner conductor free end projecting beyond said first plug outer conductor free end connects with said second plug inner conductor free end, and said second plug outer conductor free end projecting beyond said second plug inner conductor free end connects with said first plug outer conductor free end, such that said connector forms an overlap region when said plugs are electrically connected and at least partially engaged; and wherein said first plug engages and connects with said second plug to form a continuous signal pathway through said plugs and said overlap region, whereby signal impedance "Z" remains substantially constant throughout said connector including within said overlap region, having said overlap region form part of said signal pathway.

9. The connector of claim 8 wherein the ratio of the inner diameter of said second plug outer conductor to the outer diameter of said conductive cover on the projecting portion of said first plug inner conductor and a dielectric constant of said overlap region being such that said impedance is substantially constant and is substantially the same as the impedance in said first and second plugs.

10. The connector of claim 8 wherein the inner and outer conductors of said first plug, said conductive cover on said projecting portion of said first plug inner conductor, and said second plug inner and outer conductors are shaped, and said dielectric are chosen, such that when said first plug is engaged with said second plug, along the central axis of the engaged connection the effective outer diameter of the inner conductor referenced by "d", the effective inner diameter of the outer conductor referenced by "D", and the relative dielectric constant of the medium therebetween referenced by $\epsilon$, satisfy the equation:

$$Z=138(\epsilon)^{-1/2}\log(D/d)$$

where "Z" is said signal impedance, and said impedance is substantially constant throughout the central axis of said engaged connection.

11. The connector of claim 8 further comprising having said impedance remain constant throughout a central axis of said connector as said first and second plugs are in an electrically connected, partially engaged position or an electrically connected, fully engaged position.

12. An electrical connector plug forming a signal path, said connector plug having a free end and a fixed end, comprising:

an inner conductor having an outer diameter and a free end, an outer conductor having an inner diameter and a free end, said inner conductor coaxial with said outer conductor, said inner conductor free end coincident with said connector plug free end, said inner conductor free end projecting beyond said outer conductor free end;

a dielectric spacer between said inner and outer conductors having a dielectric constant;

said fixed end attachable to a coaxial cable;

an electrically conductive cap substantially covering said inner conductor free end projecting beyond said outer conductor free end, said cap coaxial with said inner conductor, substantially cylindrical, and having an inner diameter substantially equal to said inner conductor outer diameter, and having an outer diameter larger than said inner conductor outer diameter;

said connector plug adapted to engage and electrically connect with a coaxial mating plug having corresponding inner and outer conductors and a dielectric spacer therebetween having said dielectric constant;

wherein said free end of said projecting conductor of said connector plug and said cap are adapted to overlap with said free end of said projecting conductor of said mating plug, forming an overlap region when said plugs are electrically connected and at least partially engaged; and wherein all along said signal path, the ratio of the inner diameter of the outer conductor to the outer diameter of the inner conductor along with said dielectric constant being such that said impedance is substantially constant throughout the central axis of said connector plug.

13. The connector plug of claim 12 wherein said conductive cap is bullet-shaped, having a cylindrical body and a contoured, slightly pointed end, said cylindrical body having a substantially constant outer diameter.

14. The connector plug of claim 12 further comprising said ratio calculated such that when said connector plug is engaged with said mating plug, along the central axis of the engaged connection the effective outer diameter of the inner conductor referenced by "d", the effective inner diameter of the outer conductor referenced by "D", and a relative dielectric constant of the medium therebetween referenced by $\epsilon$, satisfy the equation:

$$Z=138(\epsilon)^{-1/2}\log(D/d)$$

where "Z" is said signal impedance, and said impedance is substantially constant throughout the central axis of said engaged connection.

15. A coaxial electrical connector plug having a free end and a fixed end, comprising:

an outer conductor having an inner diameter $D_1$;

an inner conductor having an outer diameter $d_1$;

a portion of said inner conductor extending beyond said outer conductor at said connector plug's free end;

a conductive cap over said inner conductor portion extending beyond said outer conductor, said cap having an outer diameter $d_3$;

wherein said connector plug is adapted to connect with a mating plug having an inner conductor with an outer diameter $d_2$, an outer conductor with an inner diameter $D_2$, and a portion of said outer conductor extending beyond said inner conductor, said portion outer conductor having an inner diameter $D_3$;

such that when said connector plug is at least partially engaged with said mating plug, the ratios of the diameters: $D_1/d_1$, $D_2/d_2$, and $D_3/d_3$ are substantially equal.

* * * * *